US005576525A

United States Patent [19]

Umemura

[11] Patent Number: 5,576,525

[45] Date of Patent: Nov. 19, 1996

[54] PUSH BUTTON DETENT OR RETAINING MECHANISM FOR PUSH BUTTON SWITCH

[75] Inventor: Heihachiro Umemura, Sakai, Japan

[73] Assignee: Shinkoh Electric Co., Ltd., Osaka, Japan

[21] Appl. No.: 558,654

[22] Filed: Nov. 16, 1995

[30] Foreign Application Priority Data

Nov. 22, 1994 [JP] Japan ..... 6-312772

[51] Int. Cl.[6] ..... H01H 3/20

[52] U.S. Cl. ..... 200/539; 200/538; 200/520; 200/530

[58] Field of Search ..... 200/521, 520, 200/539, 538, 537, 341, 565, 556, 336, 566

[56] References Cited

U.S. PATENT DOCUMENTS 4,656,323 4/1987 Schlosser ..... 200/521
4,927,990 5/1990 Aoki et al. ..... 200/521

FOREIGN PATENT DOCUMENTS 2948432 6/1981 Germany ..... 200/521

*Primary Examiner*—David J. Walczak
*Attorney, Agent, or Firm*—Wenderoth, Lind & Ponack

[57] ABSTRACT

A push button is provided with a steel ball pressed by a spring. A separate retaining spring retains the steel ball in a gap between coils of the retaining spring. The push button thus is retained at prescribed pressed down positions.

9 Claims, 15 Drawing Sheets

FIG. 4(a)
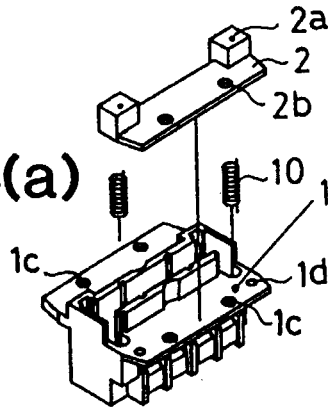
FIG. 4(b)
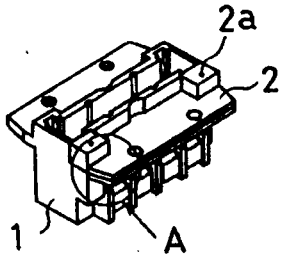
FIG. 4(c)
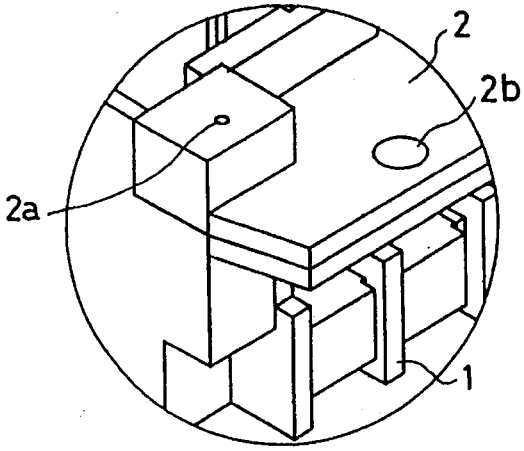
FIG. 4(d)
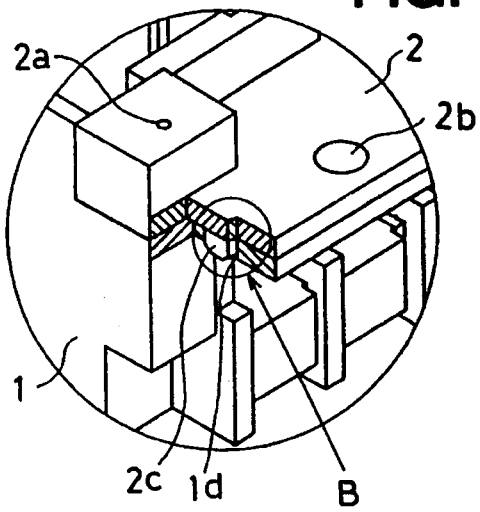
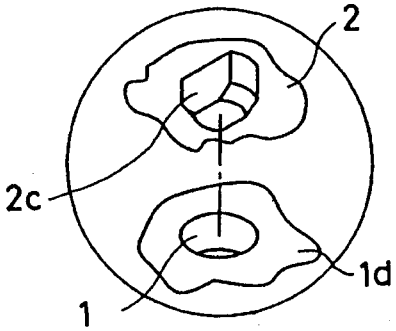
FIG. 4(e)

| CONTACTS | PB1 | PB2 | OUT PUT |
|---|---|---|---|
| ①-② | 0 | 0/1/2/3 | OFF |
| | 1/2/3 | – | ON |
| ⑤-⑥ | 0/1 | 0/1 | OFF |
| | 2/3 | 2/3 | ON |
| ⑦-⑧ | 0/1/2 | 0/1/2 | OFF |
| | 3 | 3 | ON |
| ③-④ | 0/1/2/3 | 0 | OFF |
| | – | 1/2/3 | ON |

0: NO OPERATION

1: FIRST STEP OPERATION

2: SECOND STEP OPERATION

3: THIRD STEP OPERATION

FIG. 8(a)
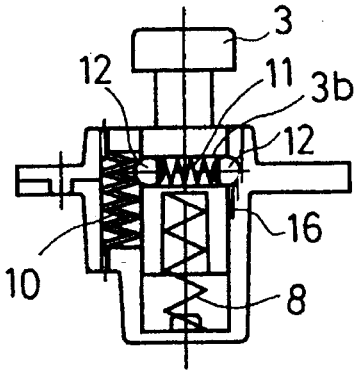
FIG. 8(b)
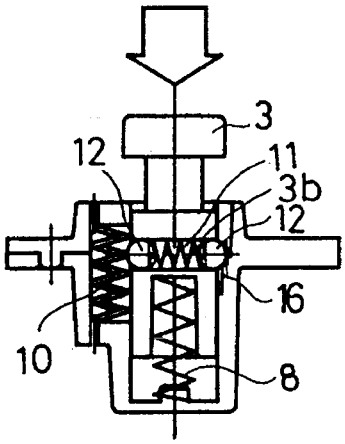
FIG. 8(c)
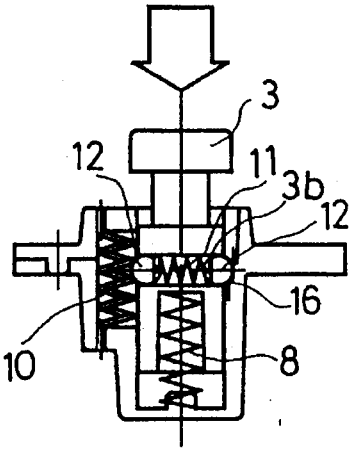
FIG. 8(d)
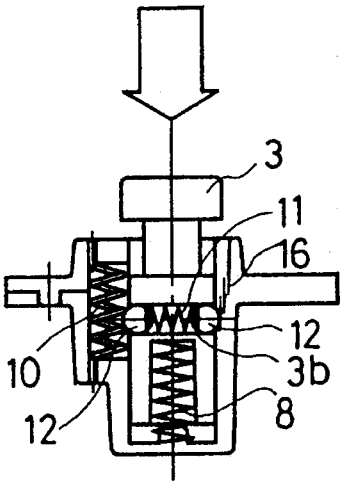
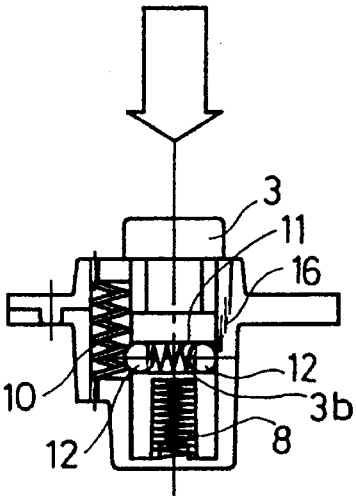
FIG. 8(e)

FIG. 13(a)
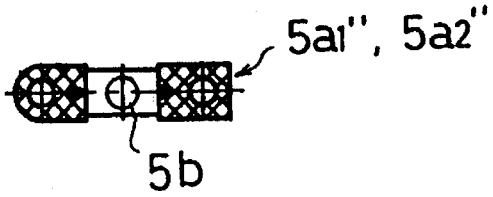
FIG. 13(b)
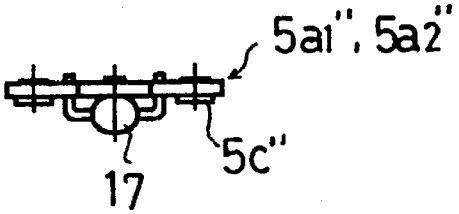
FIG. 13(c)
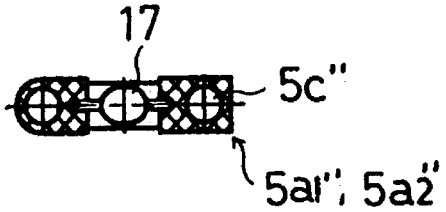
FIG. 14(b)
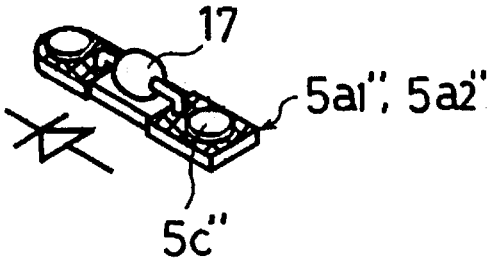
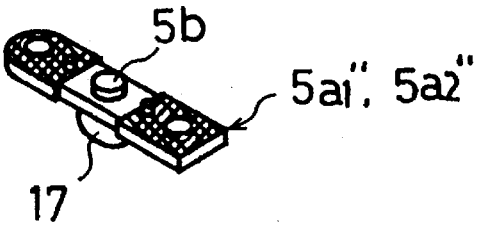
FIG. 14(a)

| CONTACTS | PB1 | PB2 | OUT PUT |
|---|---|---|---|
| ①-② | 0 | 0/1/2/3 | |
| | 1/2/3 | – | |
| ⑤-⑥ | 0/1 | 0/1 | |
| | 2/3 | 2/3 | |
| ⑦-⑧ | 0/1/2 | 0/1/2 | |
| | 3 | 3 | |
| ③-④ | 0/1/2/3 | 0 | |
| | – | 1/2/3 | |

0: NO OPERATION

1: FIRST STEP OPERATION

2: SECOND STEP OPERATION

3: THIRD STEP OPERATION

PUSH BUTTON DETENT OR RETAINING MECHANISM FOR PUSH BUTTON SWITCH

BACKGROUND OF THE INVENTION

The present invention relates to multistage push-button switches used, for example, in the operation of cranes and hoists, and more specifically to a detent or retaining mechanism for a push button that provides for temporary stopping thereof at prescribed intermediate positions when the push button of a push-button switch is pressed down.

As a retaining mechanism for a push button providing temporarily stoppage thereof at prescribed intermediate positions when the push button of a push-button switch is pressed down, the conventional type mechanism that is widely used is illustrated in FIG. 18 and includes steel balls 12 pressed apart by a spring 11 in a push button 3 forward one of plural stepped parts 16 spaced in an axial direction of movement of push button 3 and formed on opposite inner wall faces of switch body 1. Push button 3 is retained at a prescribed pressed position by steel balls 12 being retained at a particular step 16 when the push button 3 is pressed down, as shown in FIG. 18.

In such mechanism of conventional push buttons, the stepped part 16 must be formed in the shape of tapered steps because the switch body 1 is made of synthetic resin. For that reason, the more the push button 3 is pressed down, the greater the pressing force on the spring 11, making it impossible to maintain a constant pressing force of the clipped push button 3. As a result, this arrangement has poor durability, since when pressing the push button 3 the force required to move from a first step 16 to a second step 16 and from the second step 16 to a third step 16 becomes extremely large. Thus, the stepped parts 16 are liable to become worn by contact with the steel balls 12.

SUMMARY OF THE INVENTION

The object of the present invention is to provide a push button detent or retaining mechanism in a push-button switch of high durability and capable of maintaining a force required for constant pressing of a retained push button.

To achieve such object, the push button retaining mechanism of a push-button switch of the present invention is provided with steel balls pressed by a spring in the push button, and a separate retaining spring operable to retain the push button at prescribed pressed positions by engaging at least one of the steel balls in respective gaps of the retaining spring when the push button is pressed down.

The push button retaining mechanism in the push-button switch of the present invention, which retains the push button at prescribed pressed down positions by engaging the steel ball in respective gaps of the retaining spring when the push button is pressed down, can maintain the force required for constant pressing down of the retained push button and also can improve the durability of the push-button switch because the retaining spring that comes into contact with the steel ball is not easily worn.

It is also possible to retain the push button at prescribed pressed down positions by providing the retaining spring on the switch body and forming a stepped part. When the push button is pressed down, the steel ball on one side is retained in a gap of the retaining spring and the other steel ball is retained at the stepped part. Thereby, it becomes possible to set an increased amount of force required for moving from a first step to a second step and from the second step to a third step while maintaining an optimal level of constant retaining force by the retaining spring and improving the operational reliability of the push-button switch, thus eliminating operating errors of the push-button switch.

BRIEF DESCRIPTION OF THE DRAWINGS

FIGS. 4(*a*)–4(*e*) respectively are an exploded perspective view, an assembled perspective view, a perspective view of area A shown in FIG. 4(*b*), a perspective sectional view of area A, and an enlarged perspective view of portions of area A, illustrating assembly of a spring fastening base.

FIGS. 8(*a*)–8(*e*) are sectional views showing different positions of the push button of the push-button switch of FIG. 2.

FIGS. 13(*a*)–13(*c*) respectively are a plan view, a front view, and a bottom view of a moving contact of the push-button switch of FIG. 12.

FIGS. 14(*a*) and 14(*b*) respectively are a perspective view of the moving contact as viewed looking upwardly, and a perspective view of the moving contact as viewed looking downwardly.

DETAILED DESCRIPTION OF THE INVENTION

Figure 1:
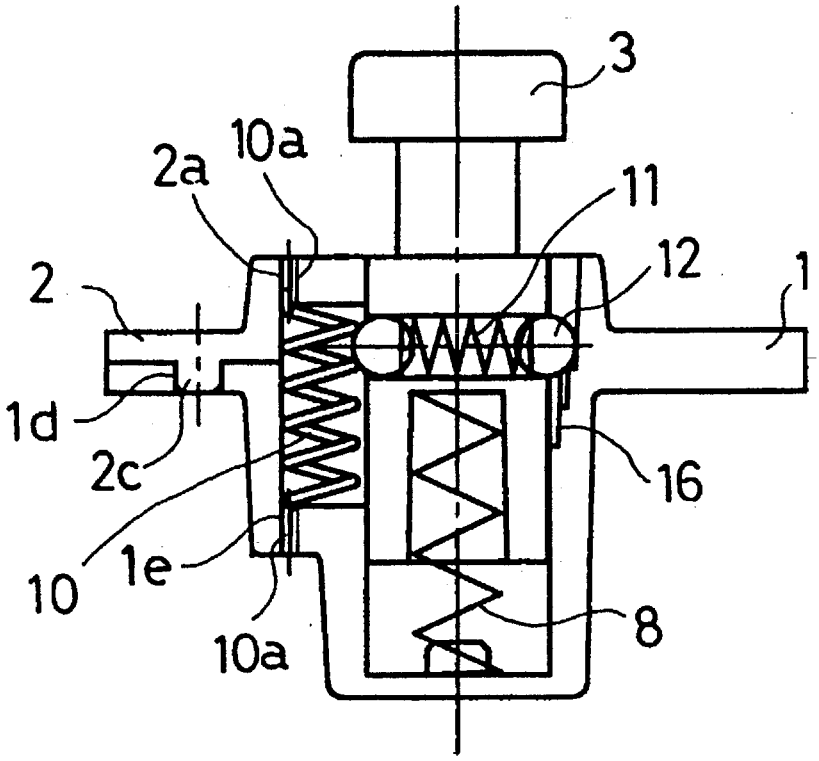
FIG. 1 is a sectional view showing of a push-button switch including a first embodiment of a mechanism according to the present invention.
Figure 2A:
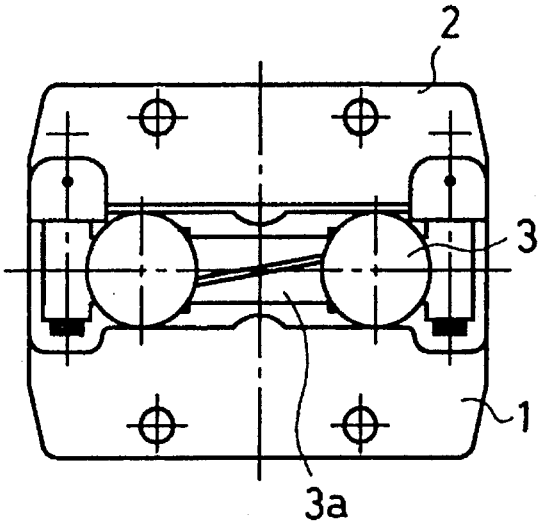
FIGS. 2(*a*)–2(*d*) respectively are a plan view, a front view, a bottom view and a side view thereof.
Figure 2D:
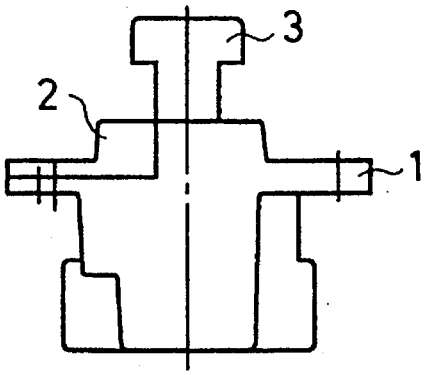
Figure 2B:
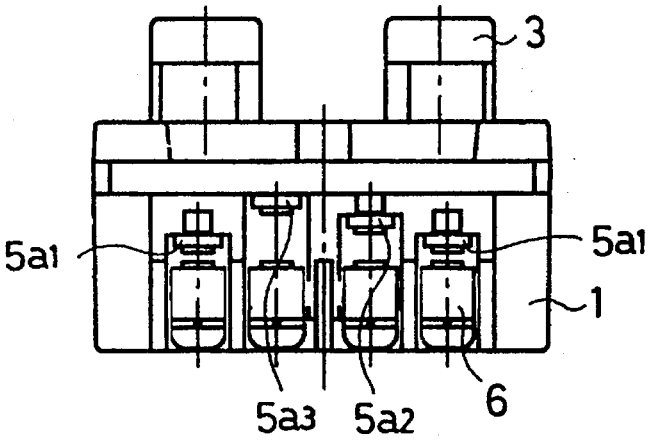
Figure 2C:
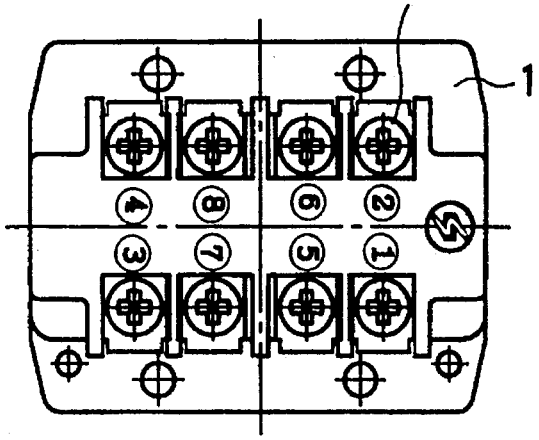
Figure 3:
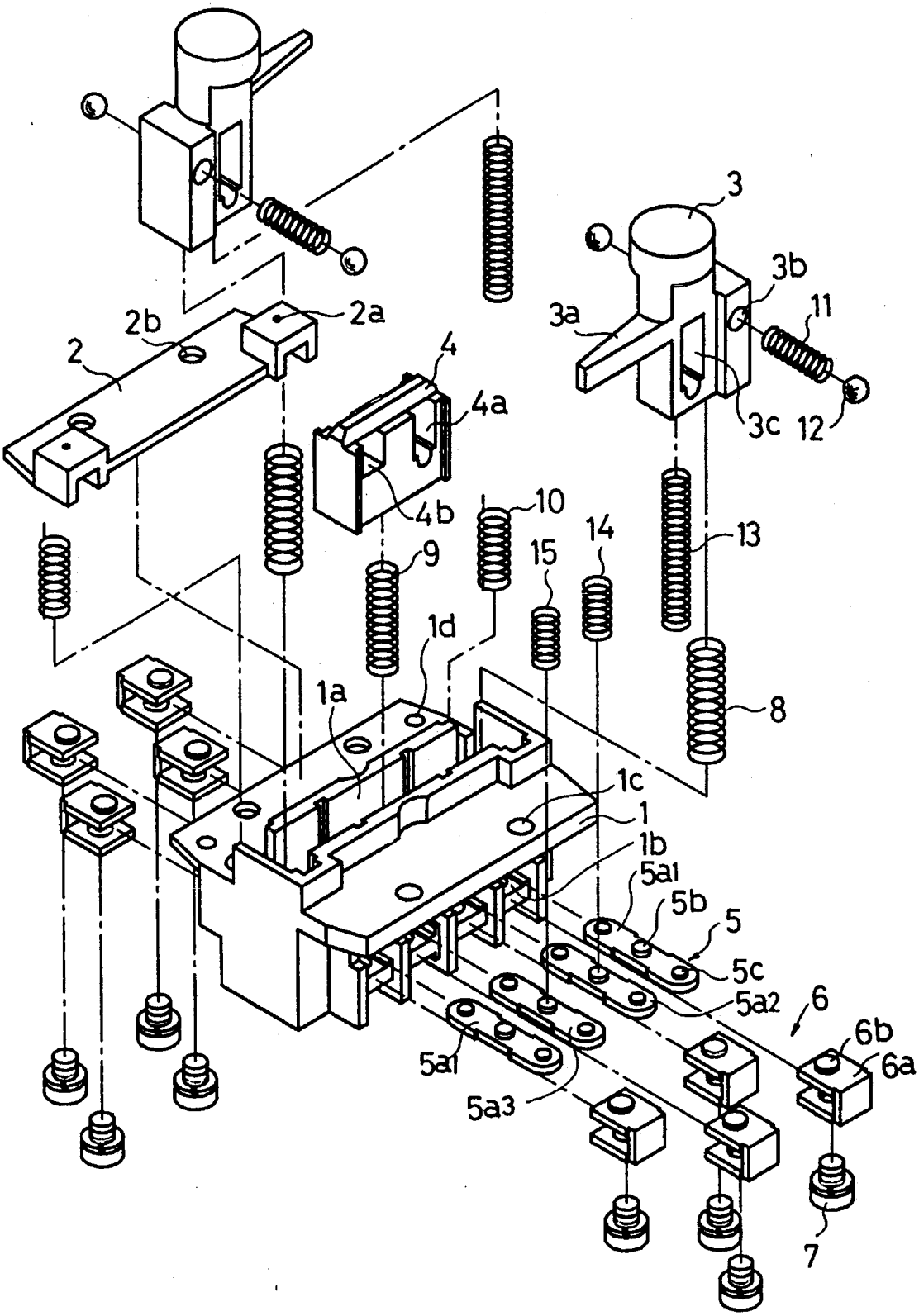
FIG. 3 is an exploded perspective view thereof.
Figure 5A:
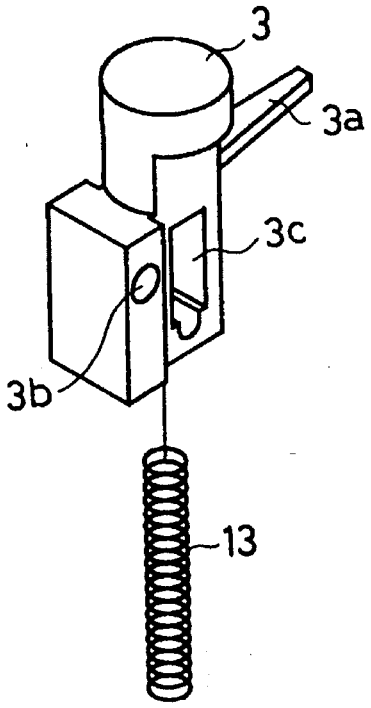
FIGS. 5(*a*)–5(*d*) are perspective views showing assembly process of the push-button switch.
Figure 5C:
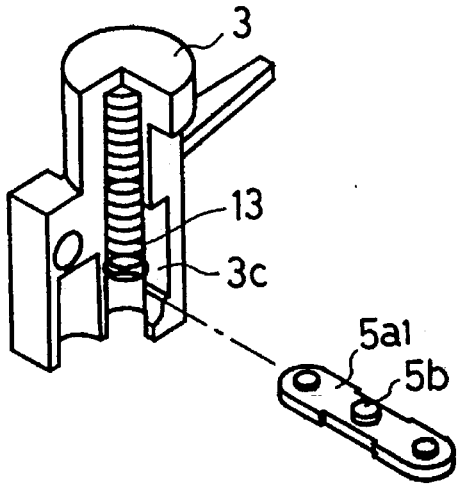
Figure 5B:
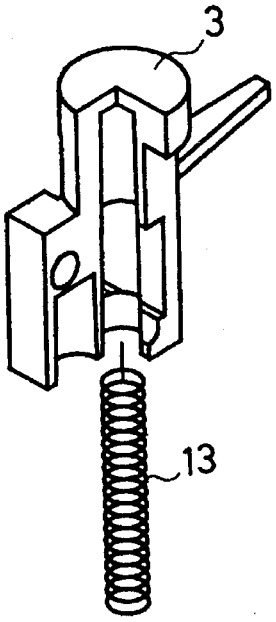
Figure 5D:
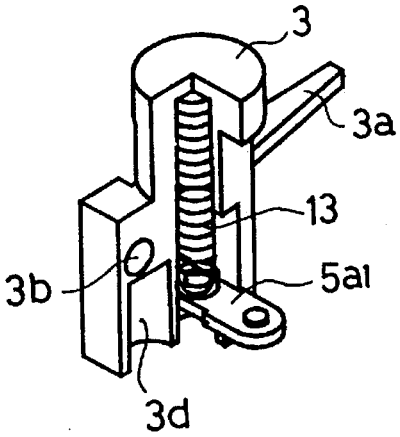

Embodiments of the push button retaining or detent mechanism in a push-button switch according to the present invention will be described with reference to the drawings.

FIGS. 1 through 8 show a first embodiment of a mechanism in a push-button switch according to the present invention for a 3-step push-button switch used for crane and hoist operations.

Such push-button switch is constructed in a manner to retain a push button member 3 at a prescribed pressed down position by disposing in push button 3 ball members such as steel balls 12 pressed apart by a ball spring 11. A retaining spring 10 faces one steel ball 12 on one side of a wall face of a storing groove 1*a* formed in a switch body 1 in which push button 3 slides, spring 10 extending parallel to a direction of movement of push button 3. A stepped portion 16 faces the other steel ball 12 and is engaged, when the push button 3 is pressed down, such other steel ball 12. At such time, the one steel ball 12 engages a coil gap between coils of retaining spring 10, thus retaining and fastening such one steel ball 12 opposite from the stepped part 16. The pitch between coils of the retaining spring 10 corresponds with the pitch between adjacent steps of the stepped part 16. Thus, the retained positions of the push button 3 is determined by the pitch between coils of the retaining spring 10 and the pitch of the steps of stepped part 16.

The 3-step push-button switch of this embodiment is a modification of an ordinary 3-step push-button switch. This push-button switch includes a spring fixing base 2 fastened to switch body 1, two push buttons 3 and a moving contact base 4 for second and third steps inserted into storing groove 1*a* formed on the switch body 1, and four pairs of fixed contacts 6 and springs 7 for wiring terminals disposed at a lower part of switch body 1. Switch body 1 has a moving contact storing window 1*b* in which to insert a moving contact 5 disposed on the push button 3 and the moving contact base 4 for the second and third steps, a screw hole 1*c* for fastening the push-button switch in a pendant switch case, a fastening hole 1*d* for fastening the spring fastening base 2 and a spring fastening hole 1*e* provided in respective required numbers. The retaining spring 10 is held between spring fastening base 2 and the switch body 1. After a positioning piece 10*a* on one end of spring 10 is inserted in spring fastening hole 1*e*, the spring fastening base 2 is fastened to the switch body 1 by tightly fitting a fastening shaft 2*c* projecting from spring fastening base 2, and a larger diameter than fastening hole 1*d*, into fastening hole 1*d*, while inserting a positioning piece 10*a* on the opposite end of spring 10 into spring fastening hole 2*a* in the spring fastening base 2. Spring fastening base 2 has screw hole 2*b* for fastening the push-button switch to the pendant switch case at a position corresponding to screw hole 1*c* in the switch body 1 as shown in FIG. 1 and FIG. 4. By such arrangement it is possible to hole the spring 10 in position between the switch body 1 and the spring fastening base 2.

Each push button 3 has a projection 3*a* for pressing down moving contact base 4 for the second and third steps disposed between the two push buttons 3. Each push button 3 has formed therein a storing hole 3*b* in which is inserted respective steel balls 12 and a spring 11, a moving contact storing window 3*c* in which is inserted a moving contact 5*a*1 for the first step, and a fastening hole 3*d* for receipt of a push button return spring 8.

As shown in FIG. 5, moving contact 5*a*1 for the first step inserted in the moving contact storing window 3*c* of the push button 3 is pressed downward by moving contact spring 13 disposed between the moving contact 5*a*1 and the push button 3. Push button 3 is inserted in the storing groove 1*a* of the switch body 1 while protected from falling as the moving contact 5*a*1 for the first step comes in contact with a top face of the moving contact storing window 1*b* in the switch body 1.

The moving contact base 4 for the second and third steps disposed between the two push buttons 3 is common to the two push buttons 3 and is pressed down together with a push button 3 by the respective projection 3*a* when either of the two push buttons 3 is pressed down. The moving contact base 4 for the second and third steps has in a body structure thereof a moving contact storing window 4*a* in which to insert moving contact 5*a*2 for the second step, a moving contact storing window 4*b* in which to insert moving contact 5*a*3 for the third step, and a hole in which to insert one end of a return spring 9 for returning moving contact base 4. The moving contact 5*a*2 for the second step and the moving contact 5*a*3 for the third step which are inserted respectively in the moving contact storing windows 4*a* and 4*b* of the moving contact base 4 are pressed downward by either second step moving contact spring 14 or a third step moving contact spring 15 a third step, respectively disposed between the moving contact 5*a*2 and the moving contact 5*a*3 and between the moving contact and the moving contact base 4. The moving contact base 4 is inserted in the storing groove 1*a* of the switch body 1 and is protected from falling by the moving contact 5*a*2 and the moving contact 5*a*3 being in contact with the top face of the moving contact storing window 1*b* in the switch body 1.

Moving contact 5 includes moving contact 5*a*1 for the first step, moving contact 5*a*2 for the second step and moving contact 5*a*3 for the third step, as well as projections 5*b* for fastening moving contact spring 13 for the first step, moving contact spring 14 for the second step, and moving contact spring 16 for the third step, and downwardly directed contacts 5*c*. Fixed contact 6 includes upwardly facing contacts 6*b* on top pieces of U-shaped fixed contact pieces 6*a*, and screws 7 for wiring terminals connected to lower parts of the fixed contact pieces 6*a*.

Figures 6, 7:
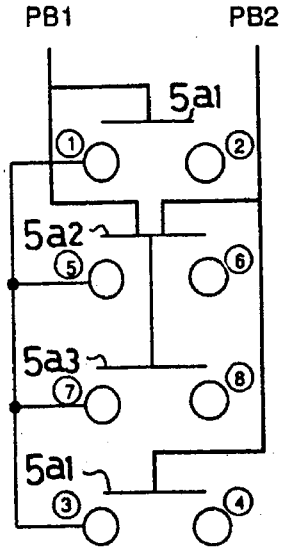
FIG. 6 is a circuit diagram of the push-button switch of FIG. 2.
FIG. 7 is a chart showing the relationship between the push button and the output of the push-button switch of FIG. 2.

FIG. 7 indicates the output of four pairs of terminals (①-②, ③-④, ⑤-⑥, ⑦-⑧) at times when the two push buttons 3 (in FIG. 6 and FIG. 7, one is described as PB1 and the other is PB2) are pressed down to the first step, the second step, and the third step, respectively, i.e. when closing a fixed contact 6 by moving contact 5*a*1 for the first step, closing of a fixed contact 6 by moving contact 5*a*2 for the second step, and closing of a fixed contact 6 by moving contact 5*a*3 for the third step are performed sequentially.

In this way, the 3-step push-button switch according to this embodiment is realized in a way to cover the output at a time when the two push buttons 3 are pressed down to the first, second, and third steps, respectively. However, the closing of fixed contact 6 by moving contact 5*a*2 for the second step and the closing of fixed contact 6 by moving contact 5*a*3 for the third step are common to the two push buttons 3. There are ten different types of outputs including a case where both of the two push buttons 3 are open and a case where both of the two push buttons 3 are closed. With four pairs of terminals (①-②, ③-④, ⑤-⑥, ⑦-⑧) instead of six pairs as required in the past, by properly combining the outputs of the four pairs of terminals at an interface, it is possible to realize miniaturization of the push-button switch, simplification of wiring and cost reduction.

Operation of the push button retaining mechanism in such push-button switch now will be explained with reference to FIG. 8.

In a position where the push button 3 is not pressed down, the steel ball 12 on the side of spring fits in a gap of the spring 10 and the steel ball 12 on the other side is pressed against the first step of stepped portion 16. Thus, push button 3 is retained in this position. The push button 3 is protected against falling since the moving contact 5*a*1 for the first step comes into contact with the top face of the moving contact storing window 1*b* in the switch body 1 (FIG. 8(*a*)).

If the push button 3 is pressed down in resistance to the pressing force of return spring 8, the steel ball 12 on one side fits into the gap between different adjacent coils of the spring 10, the steel ball 12 on the other side is pressed against the second step of stepped part 16, and the push button 3 is retained in this position (FIG. 8(*c*)). The steel balls 12 are pushed into the storing hole 3*b* of the push button 3 in resistance to the pressing force of the spring 11 by the action of the spring 10 and the second step of stepped part 16. At this time, a fixed contact 6 is closed with moving contact 5*a*1 for the first step.

If the push button 3 is pressed down further in resistance to the pressing force of the return spring 8, the steel balls 12 are pushed further into the storing hole 3*b* of the push button 3 in resistance to the pressing force of the spring 11 by the action of the spring 10 and the division between the second and third steps of the stepped part 16. After that, the steel ball 12 on one side fits into another gap between different adjacent coils of the spring 10, the steel ball 12 on the other side is pressed against the third step of the stepped part 16, and the push button 3 is retained in this position (FIG. 8(*d*)). At this time, a fixed contact 6 is closed with moving contact 5*a*2 for the second step provided on the moving contact base 4 for the second and third steps.

Yet still, if the push button 3 is further pressed down in resistance to the pressing force of the return spring 8, the steel balls 12 are pushed into the storing hole 3*b* of the push button 3 in resistance to the pressing force of the spring 11. Thereafter, the steel ball 12 on one side fits into another gap between different coils of the spring 10, and the push button 3 is retained in this position (FIG. 8(*e*)). At this time, a fixed contact 6 is closed with the moving contact 5*a*3 for the third step provided on the moving contact base 4 for the second and third steps.

The push button retaining mechanism in the push button can thus properly set the amount of increase of the force required for moving from a first step to a second step and from the second step to a third step with the stepped part 16, while maintaining a constant retaining force. Thus, retaining spring 10 makes it possible to eliminate operating errors of the push-button switch by improving its operational ability.

Figure 9:
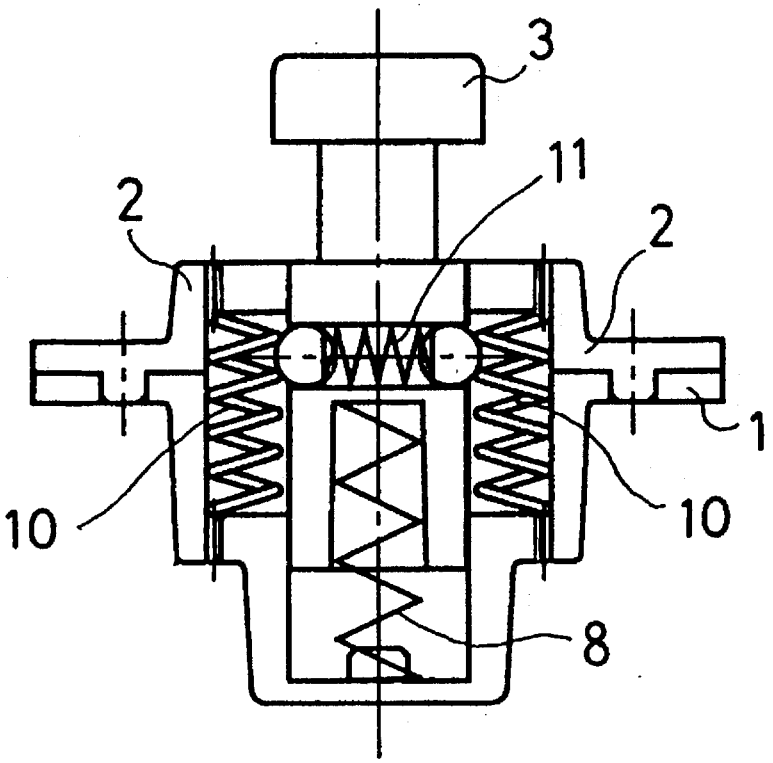
FIG. 9 is a sectional view of a push-button switch including a second embodiment of a mechanism according to the present invention.
Figure 10:
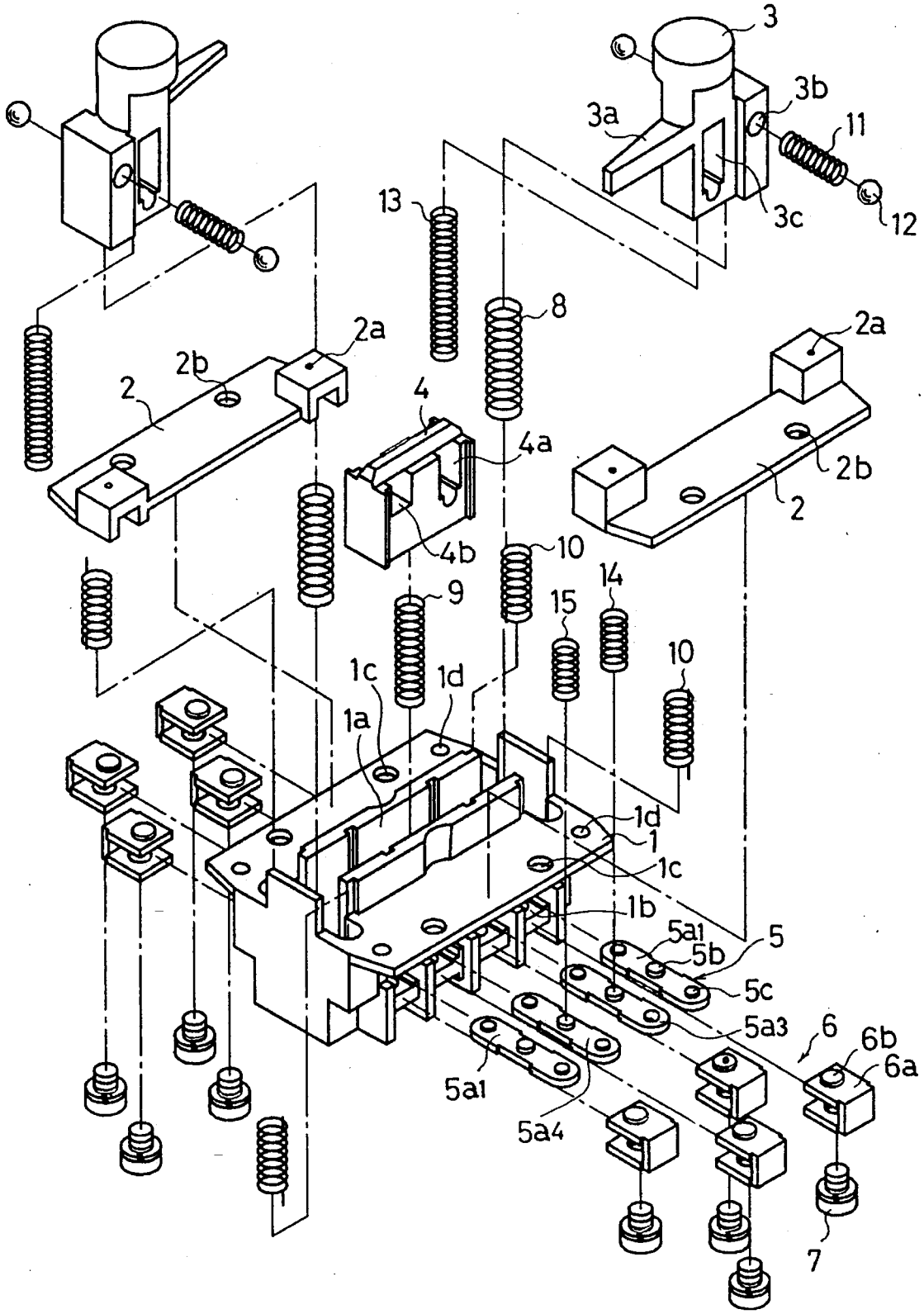
FIG. 10 is an exploded perspective view thereof.

FIG. 9 and FIG. 10 illustrate a second embodiment in which the push button retaining mechanism in the push-button switch according to the present invention is applied to a 3-step push-button switch used for a crane and boise operations. This push-button switch is constructed in such a way to retain the push button 3 at prescribed pressed down positions by disposing steel balls 12 pressed apart by a spring 11 in the push button 3, disposing two retaining springs 10 one on each side and facing a respective one of the steel balls. When the push button is pushed down, each of the steel balls 12 is engaged in a gap of the respective retaining spring 10. In this case, the construction is made in such a way that the pitch of the two opposed retaining springs 10 agree with each other. The retained positions of the push button 3 is determined by the pitch of the retaining springs 10. Other features of the construction of the push-button switch according to this embodiment are the same as that of the push-button switch according to the first embodiment, and therefore further explanation of the construction and operation of this switch are omitted.

The push button retaining mechanism thus maintains a constant force pressing down the retained push button 3 because the push button 3 is retained at a prescribed pressed down position by fitting the steel balls 12 in gaps between coils of the respective retaining springs 10. Thereby it is possible to improve the durability of the push-button switch because the retaining springs 10 that come into contact with the steel balls 12 are not easily worn.

Figure 11:
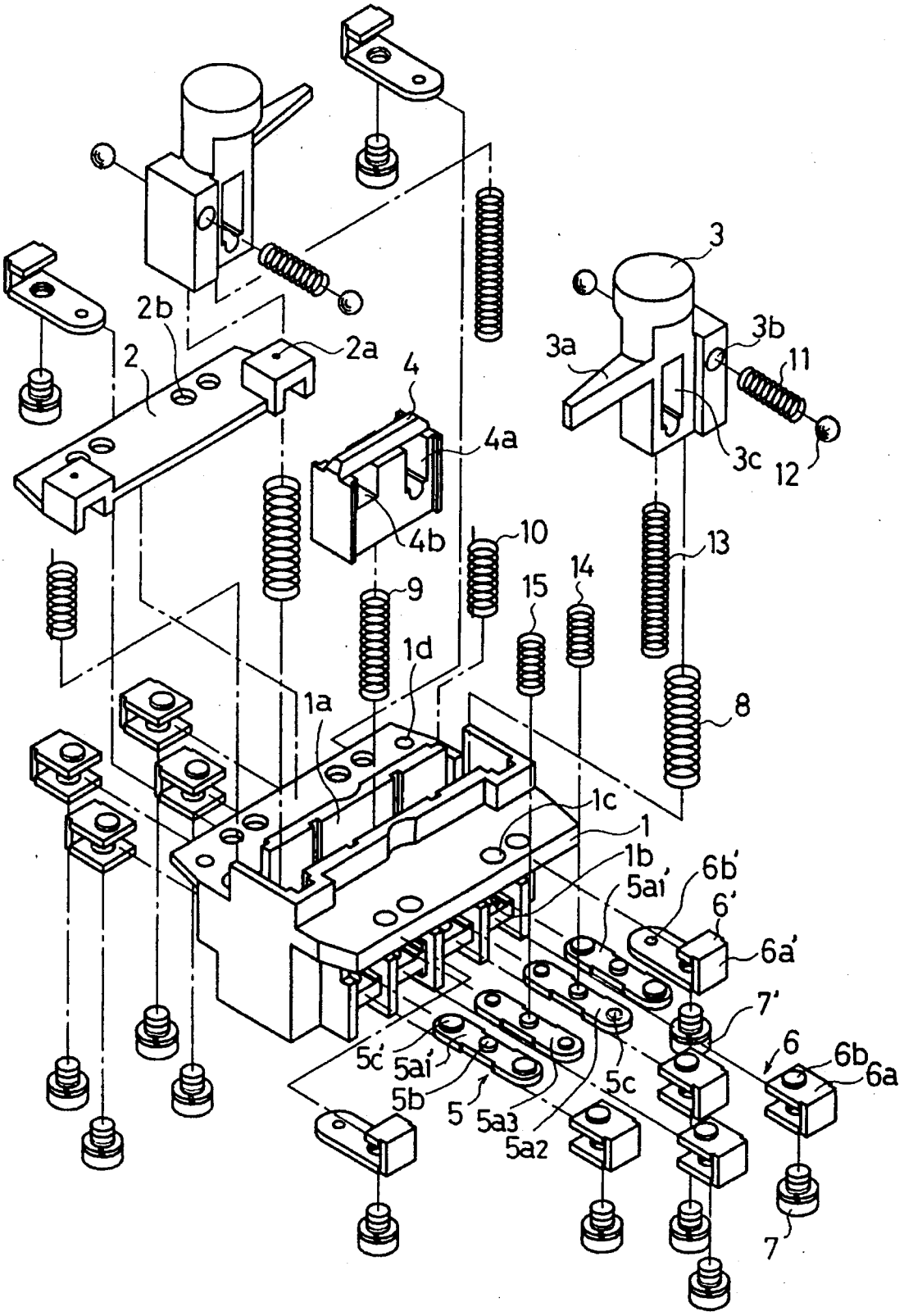
FIG. 11 is an exploded perspective view of a third embodiment.
Figure 12:
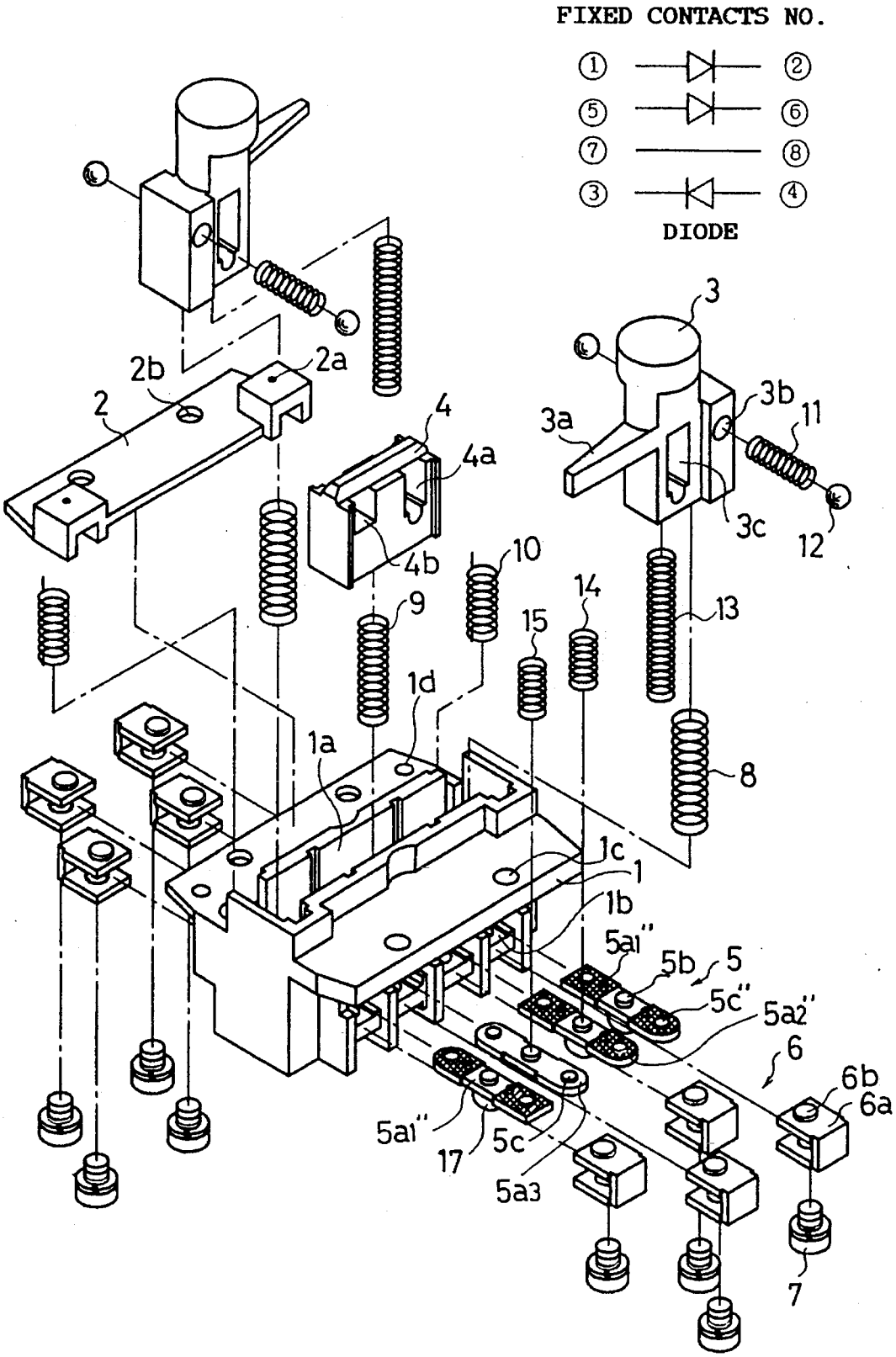
FIG. 12 is an exploded perspective view of a fourth embodiment.

FIG. 11 illustrates a modified third embodiment of the invention. This push-button switch forms a so-called B contact for obtaining an output of a state when the push button 3 is not pressed down in the push-button switch. This embodiment provides, in addition to four pairs of fixed contacts 6 at the lower part of the switch body 1, fixed contact 6' forming downwardly facing contact piece 6*b*' on the lower part of two pairs of U-shaped fixed contact pieces 6*a*' at the top of the switch body 1, an upwardly facing contact 5*c*' on moving contact 5*a*1' for the first step and a screw connecting the screw 7' for wiring terminal to the lower part of the fixed contact piece 6*a*'. Other features of the push-button switch according to this embodiment are the same as that of the push-button switch according to the first embodiment, and therefore further explanation of the construction and operation thereof are omitted. According to the push-button switch of this embodiment, when the push button on one side is pressed down, it is possible, with B contact, to turn off the output of the contact on the other side by serially connecting the B contact of the push button on one side and the contact of the push button on the other side. When both push buttons are pressed down, it becomes possible to turn off the output of the contact of the two push buttons, thus improving the safety of the push-button switch.

FIGS. 12 through 17 illustrate a modified fourth embodiment of the push-button switch of the invention. This push-button switch is constructed in such a way to selectively use full-wave AC current and positive and negative half-wave rectified currents as signal waves to be output from the push-button switch to interface 18. A diode 17 is provided in the circuit of the push-button switch of the first embodiment. The number of wires connecting the push-button switch to the interface is decreased from four in the first embodiment to two by removing a power line. Other features of the push-button switch according to this embodiment are the same as that of the push-button switch according to the first embodiment, and therefore further explanation of the construction and operation thereof are omitted. Moving contacts in the body structure are constructed with an insulator such as Bakelite, etc. and are connected between contacts 5*c*" with diode 17 as shown in FIG. 13 and FIG. 14, are used for two moving contacts, 5*a*1 for the first step and moving contact 5*a*2" for the second step, for the purpose of disposing of three diodes 17 in the circuit of the push-button switch. By forming the shape of the body structure of the moving contact 5*a*1 for the first step and moving contact 5*a*2" for the second step asymmetrically, it is possible to prevent errors in the direction of mounting (polarity of the diodes 17) of the moving contacts at the time of loading such moving contacts on the push-button switch. The diodes also can be provided in the push-button switch at a part of the switch body.

Figures 15, 16:
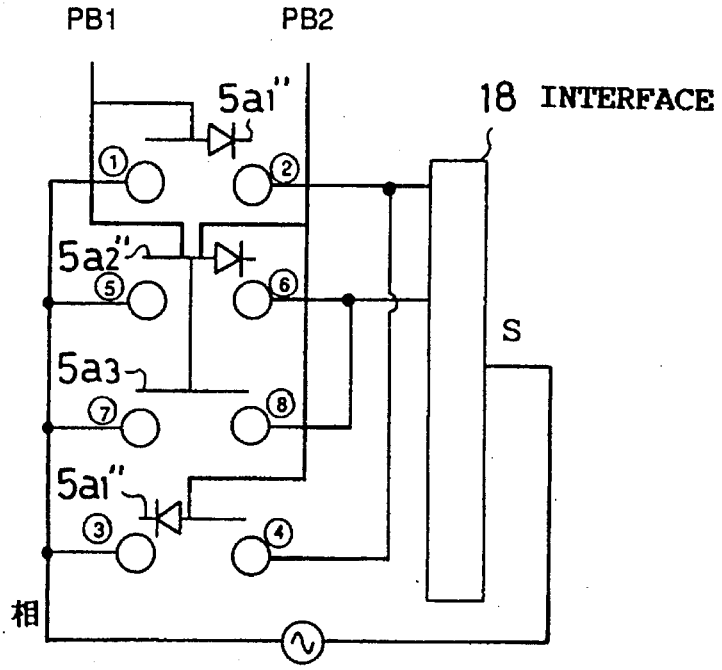
FIG. 15 is a circuit diagram of the push-button switch of FIG. 12.
FIG. 16 is a chart showing the relationship between the push button and the output of the push-button switch of FIG. 12.
Figure 17:
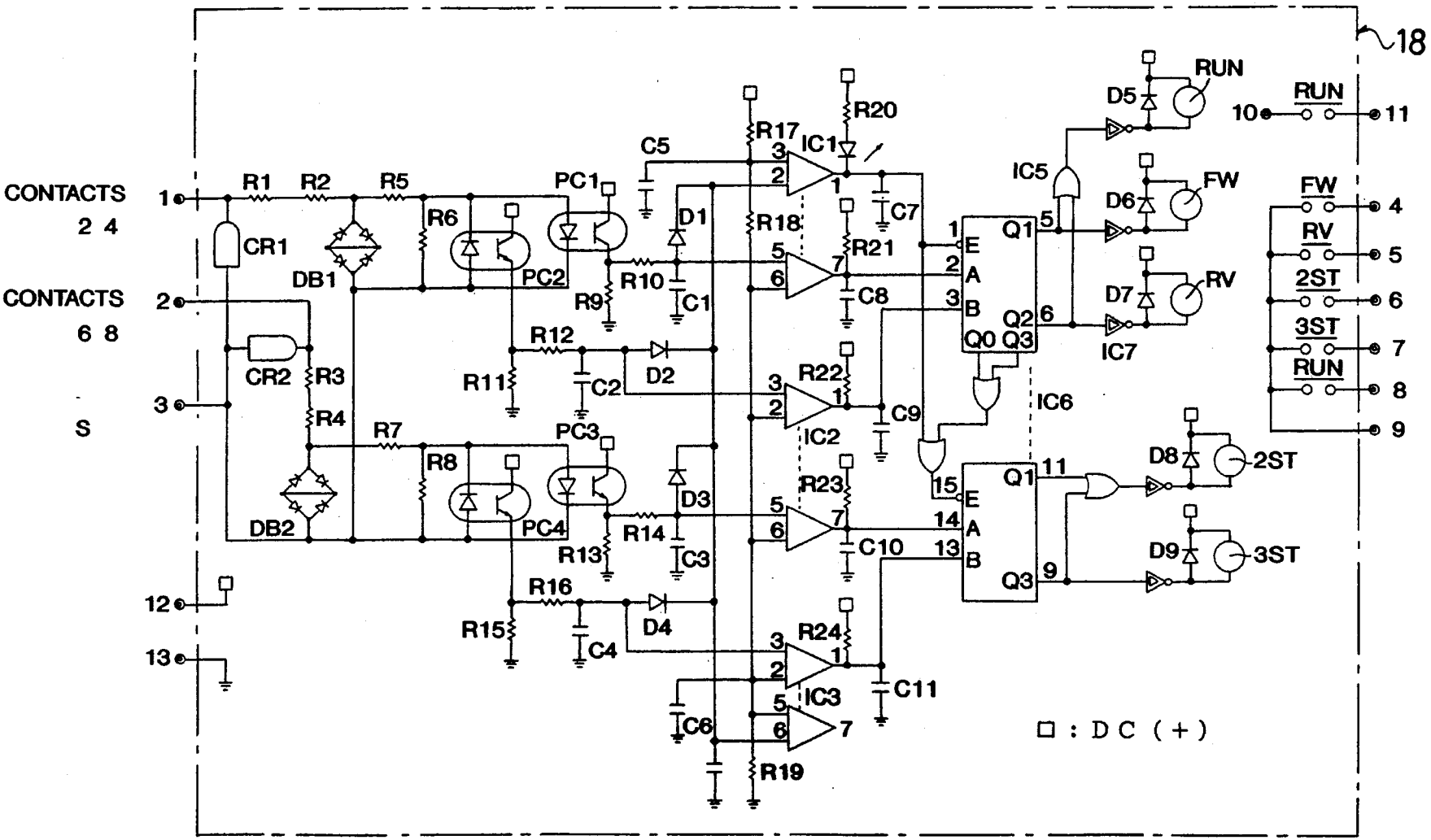
FIG. 17 is a circuit diagram of an interface of the push-button switch of FIG. 12.
Figure 18:
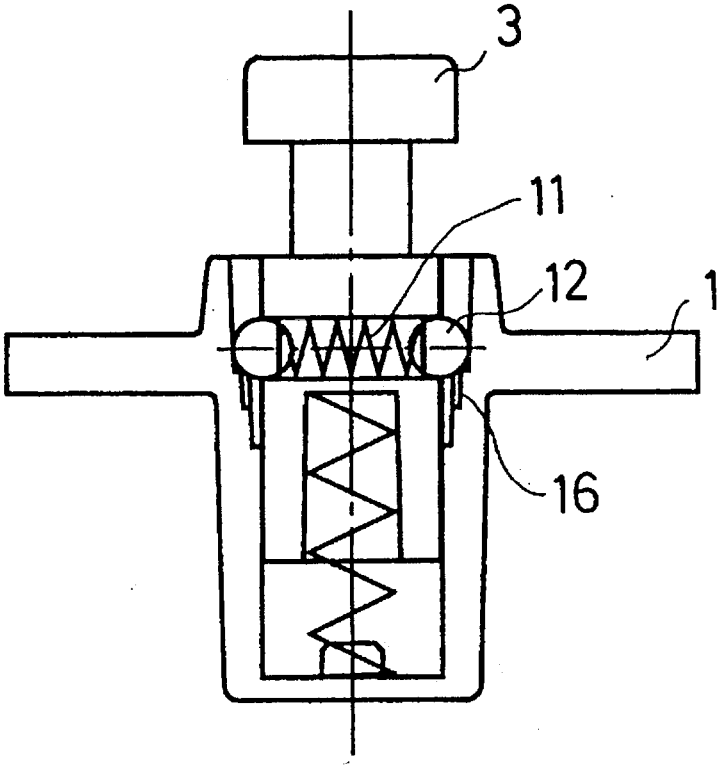
FIG. 18 PRIOR ART
FIG. 18 is a sectional view of a conventional push-button switch.

FIG. 16 indicates the output of four pairs of terminals (①-②, ③-④, ⑤-⑥, ⑦-⑧) when the two push buttons 3 (in FIG. 15 and FIG. 16, one is described as PB1 and the other as PB2) are pressed down to the first, second, and third steps, respectively, i.e. in the case where closing of fixed contact 6 by moving contact 5*a*1 for the first step, closing of fixed contact 6 by moving contact 5*a*2 for the second step, and closing of fixed contact 6 by moving contact 5*a*3 for the third step are performed sequentially. In this way, the 3-step push-button switch according to this embodiment is realized in a way to cover the output at times when the two push buttons 3 are pressed down t the first, second, and third steps, respectively. However, the closing of fixed contact 6 by moving contact 5a2 for the second step and the closing of fixed contact 6 by moving contact 5a3 for third step are common to the two push buttons 3. There are ten different types of output including cases where both of the two push buttons 3 are open and cases where both of the two push buttons 3 are closed. Four pairs of terminals (①-②, ③-④, ⑤-⑥, ⑦-⑧) are provided instead of six pairs which were required in the past. The signal waveform output by the four pairs of terminals is judged at the interface. The number of wires connecting the push-button switch and the interface is reduced from four in the first embodiment to two in the present embodiment by removing the power line, thus making it possible to realize miniaturization of the push-button switch, simplification of wiring and cost reduction, as well as elimination of operating errors or malfunctioning of the push-button switch.

Explanations have so far been given of the push button retaining mechanism in a push-button switch of the present invention based on embodiments in which the mechanism is employed on a multistage push-button switch used for a crane and hoise operations. However, the present invention can also be widely employed with push-button switches other than those of the embodiments disclosed herein.

Moreover, the features first to the fourth embodiments also can be combined as required to constitute a single push-button switch by applying the construction forming a B contact of the third embodiment to the second embodiment, etc., for example.

What is claimed is:

1. A push button switch comprising:

a switch body;

a push button member mounted in said switch body to be movable with respect thereto in a press down direction between plural pressed down positions;

a retaining spring mounted in said switch body and extending parallel to said press down direction, said retaining spring having an outer contour defining therein plural gaps spaced in said press down direction;

at least one ball member mounted on said push button member; and a ball spring mounted to urge said at least one ball member to move relative to said push button member in a direction such that when said push button member is moved in said press down direction to one of said pressed down positions, said ball spring moves said at least one ball member into a respective said gap in said retaining spring, thereby retaining said push button member in said one pressed down position.

2. A push button switch as claimed in claim 1, wherein said at least one ball member comprises a steel ball.

3. A push button switch as claimed in claim 1, comprising two said ball members, and wherein said ball spring is operable to urge said two ball members in opposite directions relative to said push button member.

4. A push button switch as claimed in claim 3, wherein said switch body has formed therein, at a position opposite said retaining spring, a stepped portion including plural steps, and said ball spring urges a first said ball member against said retaining spring and a second said ball member against said stepped portion.

5. A push button switch as claimed in claim 3, wherein first and second retaining springs are mounted on opposite sides of said push button member, and said ball spring urges a first said ball member against said first retaining spring and a second said ball member against said second retaining spring.

6. A push button switch as claimed in claim 1, wherein said ball spring urges said at least one ball member to move in a direction transverse to said press down direction.

7. A push button switch as claimed in claim 1, wherein said ball spring and said at least one ball member are mounted in a transverse bore formed in said push button member, and said ball spring urges said at least one ball member in said direction to be outwardly of said transverse bore.

8. A push button switch as claimed in claim 1, wherein said retaining spring comprises a coil spring and said plural gaps comprise spaces between respective adjacent coils of said coil spring.

9. A push button switch as claimed in claim 1, further comprising a return spring mounted between said switch body and said push button member and urging said push button member in a direction opposite to said press down direction.

* * * * *